US009301624B2

(12) United States Patent
Rosenthal et al.

(10) Patent No.: US 9,301,624 B2
(45) Date of Patent: Apr. 5, 2016

(54) FOLDABLE PLAY YARD APPARATUS INCLUDING A CLAMP AND A METHOD OF ATTACHING A FLEXIBLE SHEET TO THE CLAMP

(71) Applicant: Thorley Industries LLC, Pittsburgh, PA (US)

(72) Inventors: Jared A. Rosenthal, Pittsburgh, PA (US); Elijah M. Wiegmann, Pittsburgh, PA (US); Robert D. Daley, Pittsburgh, PA (US); Frederick Karl Hopke, Glenshaw, PA (US); Henry F. Thorne, West View, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 0 days.

(21) Appl. No.: 13/960,101

(22) Filed: Aug. 6, 2013

(65) Prior Publication Data

US 2014/0041116 A1 Feb. 13, 2014

Related U.S. Application Data

(60) Provisional application No. 61/680,471, filed on Aug. 7, 2012.

(51) Int. Cl.
*A47C 7/00* (2006.01)
*A47D 13/06* (2006.01)

(52) U.S. Cl.
CPC ..... *A47D 13/063* (2013.01)

(58) Field of Classification Search
CPC ..... A47D 13/063; A47D 9/00; A47D 7/002; A47D 9/005; A47D 13/06; A47D 7/02; A47D 13/061; A61G 1/013; A61G 1/00; A47C 17/64
See application file for complete search history.

(56) References Cited

U.S. PATENT DOCUMENTS

| | | | |
|---|---|---|---|
| 194,266 | A | 8/1877 | Rope |
| 364,415 | A | 6/1887 | Hooper |
| 548,901 | A | 10/1895 | Welch |
| 654,972 | A | 7/1900 | Haack |
| 701,126 | A | 5/1902 | Bahrmann |
| 731,662 | A | 6/1903 | Buck |
| 739,352 | A | 9/1903 | Schuette |

(Continued)

FOREIGN PATENT DOCUMENTS

| | | |
|---|---|---|
| AU | 715883 | 2/2000 |
| CN | 2159708 Y | 1/1994 |

(Continued)

*Primary Examiner* — Timothy D Collins
*Assistant Examiner* — Richard G Davis
(74) *Attorney, Agent, or Firm* — The Webb Law Firm

(57) ABSTRACT

A foldable play yard apparatus is provided. The play yard includes a frame having a plurality of upright posts. The posts have a top, a bottom, and a clamp connected to at least one longitudinal side of the post. The play yard further includes a flexible enclosure having a plurality of edges inserted in the clamps to form walls between the upright posts. The clamp includes: a housing having an opening for receiving the edge of the enclosure and defining an interior channel within the housing; a flag piece, which is positioned in the interior channel of the housing, connected to the edge of the enclosure; and a locking piece positioned across the interior channel from the flag piece. A frictional engagement between the locking piece and the flag piece maintains the flag piece and the edge connected thereto within the interior channel.

20 Claims, 4 Drawing Sheets

(56) References Cited

U.S. PATENT DOCUMENTS 914,309 A 3/1909 Ross
929,792 A 8/1909 Seifert
1,040,909 A 10/1912 Easton
1,105,156 A 7/1914 Oliphant
1,183,819 A 5/1916 Keiser
1,246,544 A 11/1917 Chassaing
1,264,734 A 4/1918 Williams
1,360,832 A 11/1920 Villapol
1,374,333 A 4/1921 Stotler et al.
1,412,177 A 4/1922 Glaum
1,620,933 A 3/1927 Wilcox
2,062,474 A 12/1936 Pasman
2,287,907 A 6/1942 Schettler, Jr.
2,369,885 A 2/1945 Dobrenen
2,491,036 A 12/1949 Dodge
2,493,181 A 1/1950 Andersen, Jr.
2,590,315 A 3/1952 Hawley, Jr.
2,610,332 A 9/1952 Field
2,659,903 A 11/1953 Hagelfeldt
2,695,050 A 11/1954 Quick
2,697,843 A 12/1954 Skrmetti
2,710,976 A 6/1955 Martensen
2,761,153 A 9/1956 Mew
2,784,420 A 3/1957 Moltane
2,790,978 A 5/1957 Tigrett
2,796,038 A 6/1957 Pegel et al.
2,895,717 A 7/1959 Falco
2,899,693 A 8/1959 Stollenwerk
2,914,111 A 11/1959 Mize
2,950,727 A 8/1960 Dunn
2,963,712 A 12/1960 Cole
2,980,058 A 4/1961 Hoffman
2,986,150 A 5/1961 Torian
3,012,254 A 12/1961 Hamilton
3,039,478 A 6/1962 Timmons
3,041,109 A 6/1962 Eames et al.
3,064,277 A 11/1962 Gill
3,064,724 A 11/1962 Nowell
3,162,460 A 12/1964 Davidson
3,165,110 A 1/1965 Brooks
3,165,760 A 1/1965 Abajian
3,173,155 A 3/1965 Schweikert
3,183,528 A 5/1965 Jacobs et al.
3,273,862 A 9/1966 Miller
3,323,819 A 6/1967 Barker
3,339,213 A 9/1967 Spencer
3,341,096 A 9/1967 Stanley
3,358,725 A 12/1967 Bussard et al.
RE26,363 E 3/1968 Mills, II
3,438,069 A 4/1969 Long
3,466,677 A 9/1969 Glaser et al.
3,601,446 A 8/1971 Persson et al.
3,639,930 A 2/1972 Miller
3,640,576 A 2/1972 Morrison et al.
3,658,025 A 4/1972 Hood et al.
3,677,601 A 7/1972 Morrison et al.
3,783,931 A 1/1974 Assael
3,784,251 A 1/1974 Persson et al.
3,811,454 A 5/1974 Huddle
3,816,885 A 6/1974 Saether
3,851,609 A 12/1974 Stearn
3,875,623 A 4/1975 Johnston
3,878,570 A 4/1975 Donnelly
3,924,280 A 12/1975 Vaiano
3,977,721 A 8/1976 Peterson
4,018,260 A 4/1977 Baslow
4,034,772 A 7/1977 Huddle
4,053,008 A 10/1977 Baslow
4,070,716 A 1/1978 Satt et al.
4,084,360 A * 4/1978 Reckson ..... 52/63
4,105,244 A 8/1978 Colby
4,188,764 A 2/1980 Gode
4,191,361 A 3/1980 Jensen
4,202,065 A 5/1980 Sullivan
4,261,144 A 4/1981 Rizzo
4,359,792 A 11/1982 Dale
RE31,829 E 2/1985 Stearn
4,538,309 A 9/1985 Gunter
4,538,663 A 9/1985 Looker
4,558,904 A 12/1985 Schultz
4,576,364 A 3/1986 O'Fearna
4,619,216 A 10/1986 Crear, III et al.
4,641,387 A 2/1987 Bondy et al.
4,688,280 A 8/1987 Kohus et al.
4,703,525 A 11/1987 Shamie
4,739,527 A 4/1988 Kohus et al.
4,750,223 A 6/1988 D'Arcy et al.
4,757,854 A 7/1988 Rippberger
4,790,340 A 12/1988 Mahoney
4,811,437 A 3/1989 Dillner et al.
4,848,843 A 7/1989 Gibbs
4,865,066 A 9/1989 Brooks
4,887,626 A * 12/1989 Dalo et al. ..... 135/119
4,898,111 A 2/1990 Hackney
4,899,496 A 2/1990 Chew, II
4,900,011 A 2/1990 Nolet
4,921,369 A 5/1990 Chew, II et al.
4,967,432 A 11/1990 Kujawski et al.
4,972,789 A 11/1990 Greppi
4,985,948 A 1/1991 Mariol
5,140,718 A 8/1992 Toth
5,203,055 A 4/1993 Broadwater, Sr.
5,205,086 A 4/1993 Heim
5,224,306 A 7/1993 Cramer
5,237,785 A 8/1993 Lukes
5,318,348 A 6/1994 Hess
5,338,091 A 8/1994 Miller
5,343,824 A 9/1994 Floyd
5,396,669 A 3/1995 Nieminen
5,414,873 A 5/1995 Wolf
5,463,970 A 11/1995 Hartlmeier et al.
5,507,563 A 4/1996 Arthur, Jr.
5,517,707 A 5/1996 LaMantia
5,544,864 A 8/1996 Gabriel-Lacki et al.
5,570,905 A 11/1996 Dyer
5,592,729 A 1/1997 Dyer et al.
5,613,543 A 3/1997 Walton
5,662,383 A 9/1997 Hand
5,716,101 A 2/1998 Frinier et al.
5,732,755 A 3/1998 Cross
5,752,297 A 5/1998 Ramey
5,758,868 A 6/1998 Shea
5,762,403 A 6/1998 Robinson
5,778,465 A 7/1998 Myers
5,845,349 A 12/1998 Tharalson et al.
5,867,850 A 2/1999 Mariol
5,911,478 A 6/1999 Goodman
5,957,048 A * 9/1999 Newman, Jr. ..... 101/127.1
5,984,417 A 11/1999 Wang
5,992,348 A 11/1999 Harding
6,004,182 A 12/1999 Pasin
6,032,433 A * 3/2000 Hatziathanasiou ..... 52/742.12
6,076,448 A 6/2000 Rexroad
6,098,217 A 8/2000 Hammil
6,123,091 A 9/2000 Flynn et al.
D432,339 S 10/2000 Cromer, III
6,148,488 A 11/2000 Gristock
6,158,067 A 12/2000 Cheng
6,192,535 B1 2/2001 Warner, Jr. et al.
6,216,291 B1 4/2001 Eads et al.
6,263,894 B1 7/2001 LaMantia
6,293,624 B1 9/2001 Gaylord et al.
6,370,714 B1 4/2002 Elzenbeck
6,402,116 B1 6/2002 Northup
6,406,093 B1 6/2002 Miotto et al.
6,425,150 B1 7/2002 Cheng
6,438,773 B1 8/2002 Hsia
6,467,108 B1 10/2002 Wang
6,470,901 B1 10/2002 Scherer
6,510,570 B2 1/2003 Hartenstine et al.
6,511,562 B1 1/2003 Coffield
6,539,563 B1 4/2003 Hsia
6,560,827 B1 5/2003 Gross
6,585,323 B2 7/2003 Gaylord et al.

(56) References Cited

U.S. PATENT DOCUMENTS

| | | | | |
|---|---|---|---|---|
| 6,623,079 | B2 * | 9/2003 | Gregory | 297/440.11 |
| 6,665,895 | B1 | 12/2003 | St. Pierre et al. | |
| 6,687,930 | B1 | 2/2004 | Eads et al. | |
| 6,694,547 | B1 | 2/2004 | Vail | |
| 6,779,849 | B1 | 8/2004 | Harper et al. | |
| 6,859,957 | B1 | 3/2005 | Chen | |
| 6,859,958 | B2 | 3/2005 | LaMantia | |
| 6,874,177 | B2 | 4/2005 | Hsia | |
| 7,013,505 | B2 | 3/2006 | Martin | |
| 7,063,096 | B2 | 6/2006 | Stoeckler | |
| 7,090,201 | B2 | 8/2006 | Brucker | |
| 7,125,081 | B2 | 10/2006 | Church et al. | |
| 7,526,821 | B2 | 5/2009 | Chen et al. | |
| 7,568,242 | B2 | 8/2009 | Troutman | |
| 7,752,688 | B2 * | 7/2010 | Chen et al. | 5/93.1 |
| RE43,919 | E | 1/2013 | Chen | |
| 8,490,227 | B2 | 7/2013 | Troutman | |
| 9,027,180 | B2 | 5/2015 | Troutman | |
| 2002/0084687 | A1 | 7/2002 | Gaylord et al. | |
| 2002/0166170 | A1 | 11/2002 | Hartenstine et al. | |
| 2003/0154547 | A1 | 8/2003 | Hsia | |
| 2003/0177574 | A1 | 9/2003 | Waldman | |
| 2005/0076589 | A1 | 4/2005 | Mills et al. | |
| 2005/0120522 | A1 | 6/2005 | Church et al. | |
| 2006/0185082 | A1 | 8/2006 | Casati Troutman | |
| 2006/0225207 | A1 | 10/2006 | Johnson | |
| 2006/0230528 | A1 | 10/2006 | Church | |
| 2008/0115269 | A1 | 5/2008 | Chen et al. | |
| 2010/0132115 | A1 * | 6/2010 | Hsu | 5/98.1 |
| 2010/0270843 | A1 | 10/2010 | Wang | |
| 2011/0233984 | A1 | 9/2011 | Lee | |
| 2015/0208822 | A1 | 7/2015 | Troutman | |

FOREIGN PATENT DOCUMENTS

| | | | |
|---|---|---|---|
| CN | 2166699 | Y | 3/1994 |
| CN | 2236272 | Y | 10/1996 |
| CN | 2289466 | Y | 9/1998 |
| CN | 1281670 | A | 1/2001 |
| CN | 1383774 | A | 12/2002 |
| DE | 3345324 | A1 | 6/1985 |
| FR | 1306748 | A | 10/1962 |
| FR | 1575822 | A | 7/1969 |
| GB | 1360375 | | 7/1974 |
| GB | 2284988 | A | 6/1995 |
| GB | 2408201 | A | 5/2005 |
| JP | 11137609 | A | 5/1999 |
| JP | 2002523165 | A | 7/2002 |
| JP | 2003510115 | A | 3/2003 |
| KR | 2019850011223 | | 9/1988 |
| WO | 02101152 | A1 | 12/2002 |

* cited by examiner

FOLDABLE PLAY YARD APPARATUS INCLUDING A CLAMP AND A METHOD OF ATTACHING A FLEXIBLE SHEET TO THE CLAMP

CROSS REFERENCE TO RELATED APPLICATION

This application claims priority to U.S. Provisional Patent Application No. 61/680,471, filed on Aug. 7, 2012, which is hereby incorporated by reference in its entirety.

BACKGROUND OF THE INVENTION

1. Field of the Invention

The present invention relates generally to a foldable child enclosure, such as a play yard, playpen, or crib apparatus, and, more particularly, to a clamp for attaching the enclosure to a frame structure.

2. Description of Related Art

Foldable play yards, playpens, and crib devices are well-known. See e.g., U.S. Pat. No. 4,811,437 for a "Foldable Playyard" to Dillner, et al. Foldable enclosure and crib devices are generally lightweight and, when collapsed, form a fairly convenient compact package for easy carrying. In many existing foldable play yards, a bed frame structure consists of upright tubes that form the frame of the bed structure and fabric sheets attached between the tubes to form the enclosure walls.

In existing foldable playpens, typically an enclosure member such as a rectangular fabric piece includes sleeves to be pulled over the upright tubes to form taut stretched walls between the tube members. Alternatively, the fabric member may be attached to the tubes with fastening members such as a screw, pins, nails, or staples. The posts support the fabric member and hold it taut to form the walls of the enclosure. Systems for fastening a fabric enclosure member to an upright tube of a foldable playpen are also known in which the fabric member is held within the tube and extends from the tube through a longitudinal slit. For example, a positioning post mounted along the edge of the fabric member may be inserted in the upright tube. In this case, the attachment mechanism may be enclosed within the tube structure. However, such systems for affixing a fabric member to the frame do not provide a secure and aesthetically pleasing connection. Accordingly, these connections also do not inspire confidence for parents that the wall structure is secure and will effectively hold the child within the enclosure. Furthermore, presently available fastening mechanisms often cause the enclosure member to stretch or tear when the playpen structure is folded or unfolded reducing the durability of the child enclosure structure.

Accordingly, there is a need for a system and method for attaching a fabric enclosure member to the frame structure of a child enclosure apparatus. The attaching system should provide a secure and permanent connection between the elements that does not stretch or lose structural integrity following prolonged use. The connection should also be sleek, attractive, and should not include external connection elements, such as screws, pins, nails, or staples, that could injure a child. In addition, the system for connecting the fabric member to the post should form a dependable and strong connection which maintains its integrity even following prolonged uses.

SUMMARY OF THE INVENTION

The foldable child enclosure apparatus of the present invention achieves these goals by attaching the edge of the fabric member in the interior channel within the upright post of the enclosure frame. More specifically, the attaching mechanism includes mounting the edge of the fabric enclosure to a piece which is inserted in the post. The piece is maintained within the post by inserting a second locking piece to form an engagement which counteracts forces seeking to remove the fabric from the attaching mechanism. The fabric member extends outward from the post through a longitudinal slit extending longitudinally along the length of the post. In this manner, the attachment mechanism is recessed within the post reducing the risk that a child will be injured by the attachment mechanism, such as would occur with an external mechanical fastener. The attachment mechanism is also visually appealing and can be folded and unfolded many times without stretching or tearing the fabric member. Finally, the attachment mechanism provides strength and stability sufficient to maintain the structural stability of the enclosure walls during normal use.

A foldable play yard apparatus is provided. The play yard includes a frame having a plurality of upright posts. The posts have a top, a bottom, and a clamp connected to at least one longitudinal side of the post. The play yard further includes a flexible enclosure having a plurality of edges inserted in the clamps to form walls between the upright posts. The clamp includes: a housing having an opening for receiving the edge of the enclosure and defining an interior channel within the housing; a flag piece, which is positioned in the interior channel of the housing, connected to the edge of the enclosure; and a locking piece positioned across the interior channel from the flag piece. A frictional engagement between the locking piece and the flag piece maintains the flag piece and the edge connected thereto within the interior channel.

According to a further aspect of the invention, a method for attaching an edge of a sheet to a clamp is provided herein. The method includes providing a clamp which includes an interior channel accessible through a longitudinal opening. The method further includes the steps of attaching the edge of the sheet to a flag piece; inserting the flag piece and edge of the sheet into the interior chamber, such that the sheet extends outward from the longitudinal opening of the clamp; and inserting a locking piece in the interior cavity to establish a frictional engagement between the flag piece and locking piece.

According to a further aspect of the invention, a method of constructing a play yard apparatus is provided herein. The method includes the step of providing a frame, including a plurality of upright posts having a top, a bottom, and longitudinal sides extending therebetween, and a flexible enclosure having a plurality of flexible sheets and a plurality of edges. The method further includes the steps of attaching a clamp along a longitudinal side of one of the upright posts, the clamp comprising a longitudinal opening and an interior channel; attaching a flag piece to the longitudinal edge of the flexible enclosure; inserting the flag piece into the interior channel of the clamp, such that the edge of the enclosure extends through the longitudinal opening of the clamp; and inserting a locking piece into the interior channel. A frictional engagement between the locking piece and the flag piece maintains the flag piece, locking piece, and edge of the enclosure within the interior channel.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

Additional aspects and advantages of the invention will become readily apparent to those skilled in the art upon reference to the provided figures and detailed description of the preferred embodiments. The invention is not limited to any particular preferred embodiment(s) disclosed.

BRIEF DESCRIPTION OF THE DRAWINGS

Some of the advantages and features of the preferred embodiments of the invention have been summarized herein above. These embodiments along with other potential embodiments of the device will become apparent to those skilled in the art when referencing the following drawings in conjunction with the detailed descriptions as they relate to the figures.

DETAILED DESCRIPTION OF THE INVENTION

Figure 1:
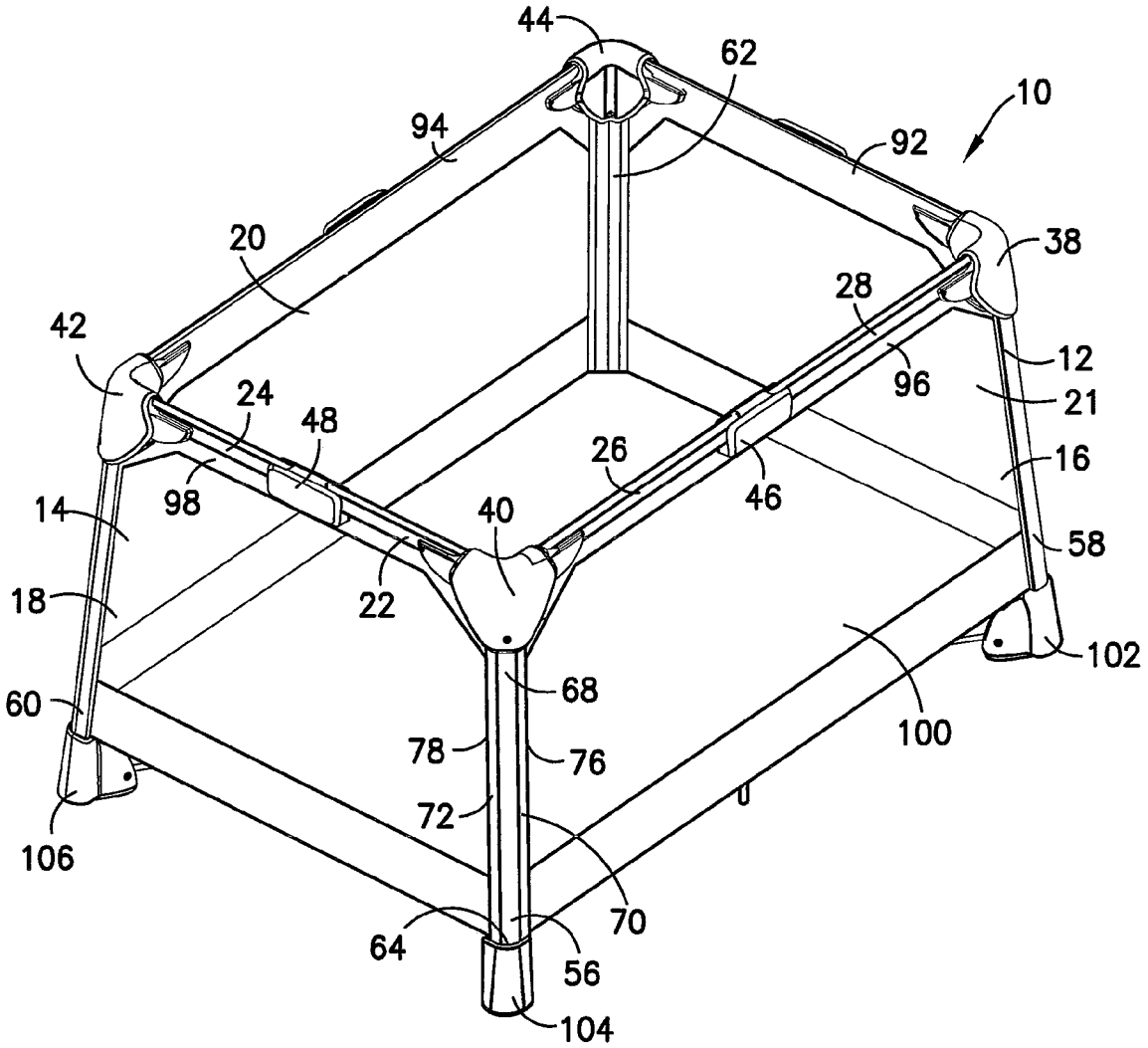
FIG. 1 is a perspective view of a foldable enclosure apparatus according to an embodiment of the invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2A:
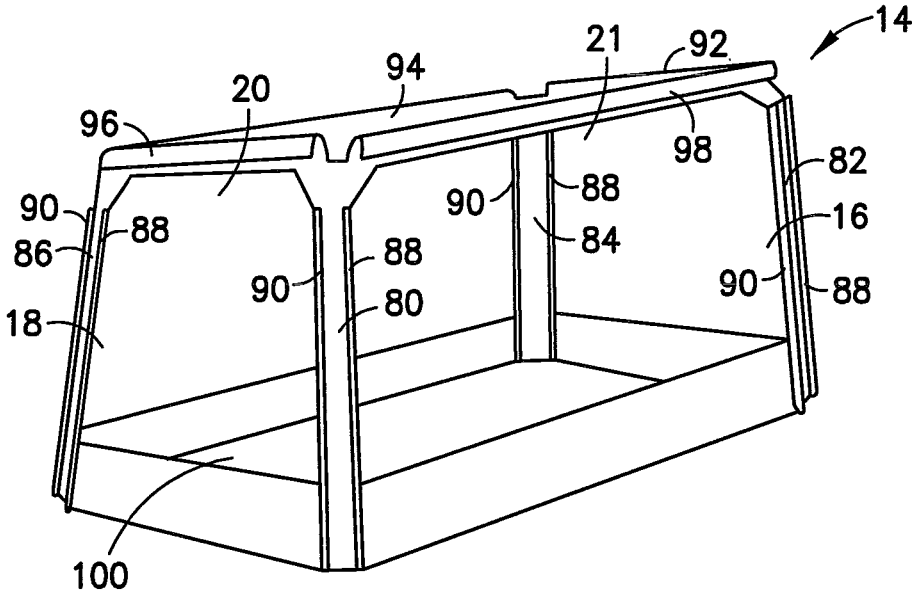
FIG. 2A is a perspective view of an enclosure of the apparatus of FIG. 1, according to an embodiment of the invention.
Figure 2B:
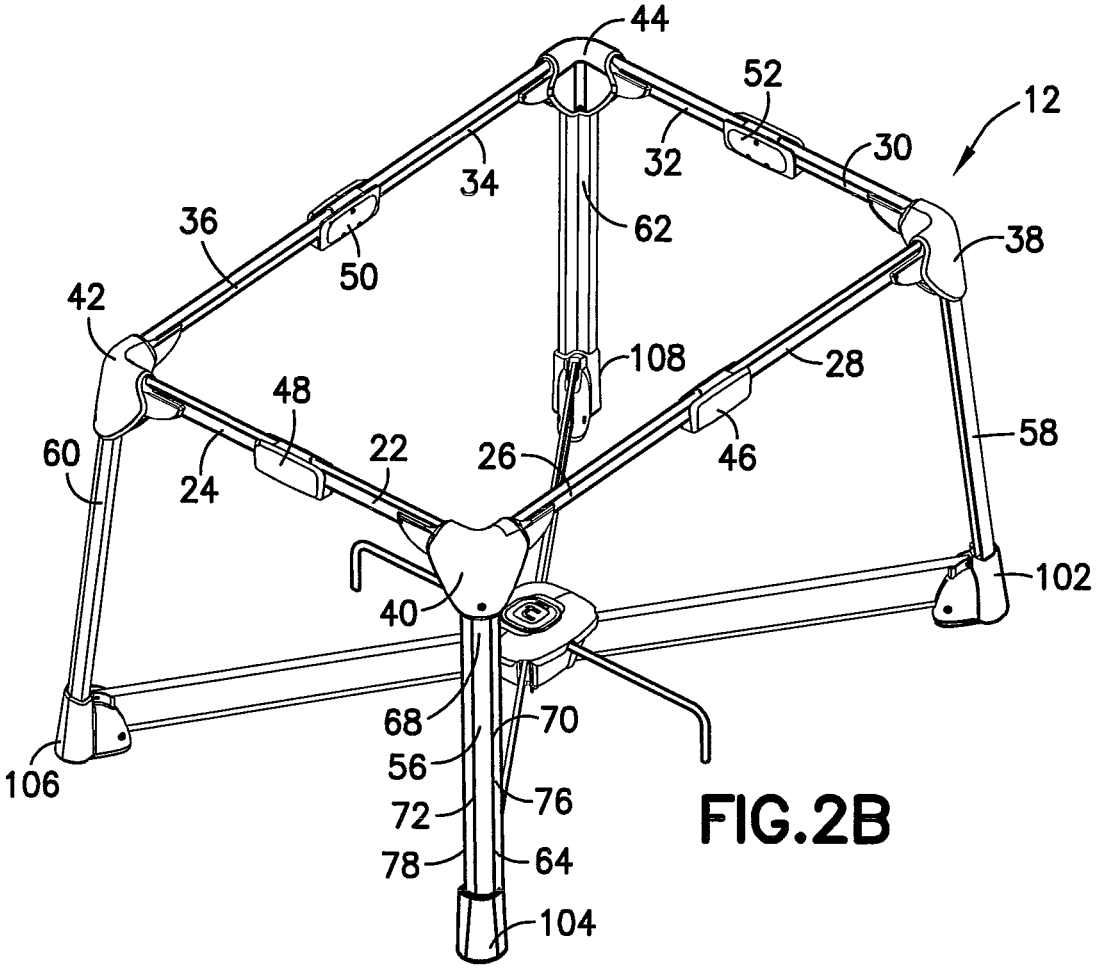
FIG. 2B is a perspective view of a frame of the apparatus of FIG. 1, according to an embodiment of the invention.

With reference to FIGS. 1-2B, a foldable enclosure apparatus 10, configured in the form of a play yard or playpen, is illustrated. The apparatus 10 is portable and, as such, is foldable, closable, or collapsible for easy transition between opened and deployed positions. The apparatus 10 includes a frame 12 connected to a flexible enclosure 14 having one or more fabric sheets that forms the walls 16, 18, 20, 21 of the playpen. The sheets may be formed from any suitable material that is flexible enough to be folded but is sufficiently strong to avoid tearing, puncturing, or stretching during prolonged use.

The frame includes eight upper arms 22, 24, 26, 28, 30, 32, 34, 36, four upper corner assemblies 38, 40, 42, 44, and four stiffening members 46, 48, 50, 52. The frame 12 further includes four generally vertically disposed upright posts 56, 58, 60, 62. To avoid redundancy, only a portion of the frame 12 will be described in detail. All other like structures of the frame 12 are configured in the same manner The upper arm 22 is pivotally connected to a corner and to the stiffening member 48 through any well-known mechanical connection such as a rivet. The remaining upper arms are arranged in a similar fashion.

The upright post 56 includes a bottom end 64, and a top end 68, connected to a respective upper corner 38. The upright post 56 may pivot or tilt outwardly and, at the same time, pull the upper corner assemblies outwardly or apart from one another. In one non-limiting embodiment, the upright post 56 has a generally L-shaped cross-section with two sides 70, 72 extending outward from a central portion 74. Clamps 76 connected to the sides of the upright post 56, extend longitudinally along each side 70, 72 of the post 56. The clamps 76 are adapted to hold and retain the flexible enclosure 14 to the post 56.

The enclosure 14 has a generally rectangular or square shape formed from four connected sheets that, when connected to the upright posts 56, 58, 60, 62 of the frame 12, become the walls 16, 18, 20, 21 of the apparatus 10. The enclosure 14 has four vertical corners 80, 82, 84, 86 that correspond to the upright posts 56, 58, 60, 62 of the frame 12. Each vertical corner 80, 82, 84, 86 includes two edges 88, 90. Each edge 88, 90 is adapted to be received within the clamp 76, 78 of the respective post 56, to support the enclosure 14 by providing structural stability for the walls 16, 18, 20, 22. The enclosure 14 may be formed from any suitable flexible material that is capable of being folded or rolled, such as natural fabrics or synthetic polymer fabrics, including but not limited to nylon, polyester, and the like. The enclosure 14 may be manufactured from a plurality of sheets that are separate from each other when connected to the frame 12 of the apparatus 10 or may be formed from a single sheet that is folded to form the plurality of walls 16, 18, 20, 21. In certain embodiments, central portions of the sheets of the enclosure 14 may be formed from a softer, mesh material (not shown) allowing the child to look through the walls to see objects outside of the enclosure.

The enclosure may further include coverings 92, 94, 96, 98, for covering the upper arms 22, 24, 26, 28, 30, 32, 34, 36 of the frame and for providing additional structure stability for the walls 16, 18, 20, 21 of the apparatus 10. The enclosure 14 may further include a base pad or mattress 100. Side padding (not shown) may also be placed around the interior of the play yard for added protection of a child placed on the pad or mattress 100.

Figure 3:
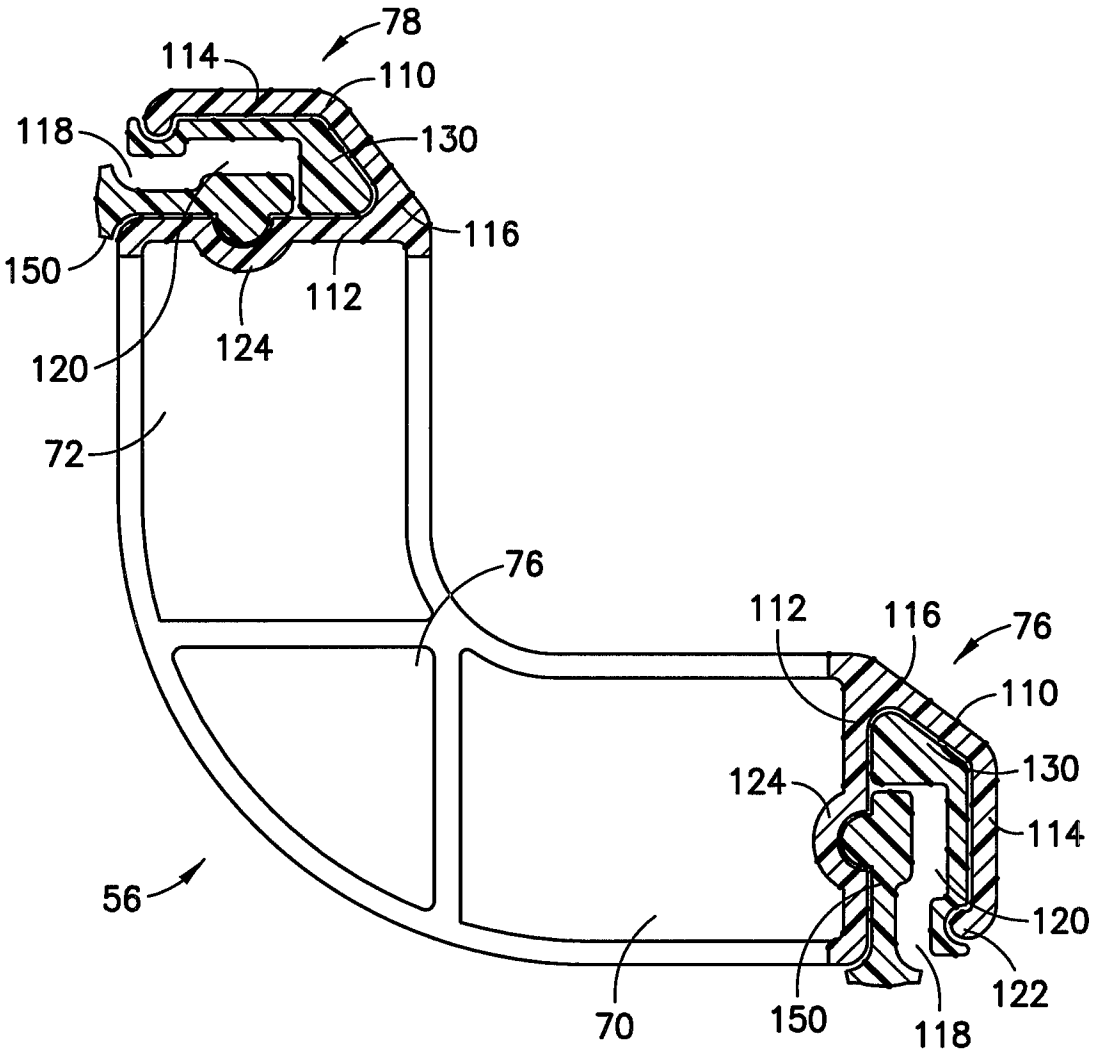
FIG. 3 is a cross-sectional view of an upright post and attached clamps of the apparatus of FIG. 1, according to an embodiment of the invention.
Figure 4:
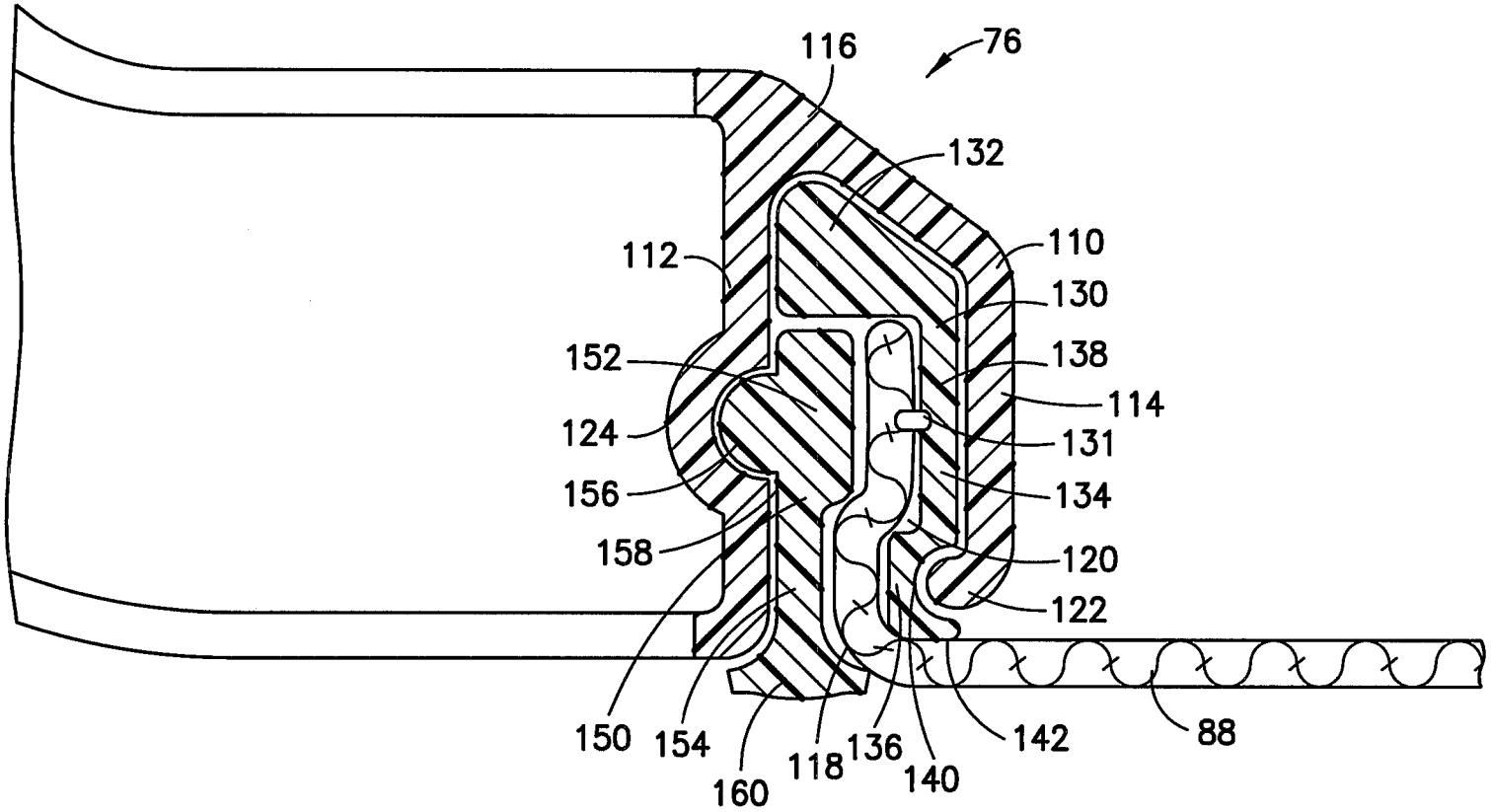
FIG. 4 is an enlarged cross-sectional view of the upright post and clamp of FIG. 3, according to an embodiment of the invention.

With reference to FIGS. 3 and 4, the clamp 76, 78 for connecting the edge 88 of the enclosure 14 to the upright post 56 is illustrated. Once again, to prevent redundancy, the structure of only one clamp structure is described herein. However, it is understood that an identical clamp is included on each side of each upright post. Accordingly, in one non-limiting embodiment, the apparatus 10 of the present invention will include eight clamps for securing the enclosure 14 to the four respective posts 56.

The clamp 76 includes a u-shaped housing 110 having a proximal arm 112 and a distal arm 114. As used herein, "proximal" refers to the portion of the clamp nearest the upright post. "Distal" refers to the portion of the clamp farthest away from the upright post. The arms 112, 114 are attached together at a hub 116 and extend in an outward direction to define a slit like opening 118 at an opposite end of the housing from the hub 116. The slit like opening 118 extends longitudinally along the length of the post 56. The proximal arm 112 is connected to the side 70 of the upright post 56. The housing 110 may be integrally formed with the upright post 56, such that the side 70 of the post forms the proximal arm 112 of the clamp housing 110. Alternatively, the clamp 76 may be a separate structure attached to the post 56 be conventional means such as fasteners or adhesives. The space between the arms of the housing defines an interior channel 120 adapted to receive and hold an edge 88 of the enclosure 14. The edge 88 extends from the clamp housing 110 through the slit opening 118. As previously described, the edges 88 form the walls (not shown in FIGS. 3 and 4) between adjacent upright posts 56.

With continued reference to FIGS. 3 and 4, in one non-limiting embodiment, a flag piece 130 is attached to each edge 88 of the enclosure 14. The flag piece 130 may be connected to the edge 88 of the enclosure 14 by any conventional connector 131, such as stitching, fasteners, or adhesives. The flag piece 130 is adapted to be retained within the clamp housing 110 and, specifically, to be positioned adjacent to the distal arm 114. The flag piece 130 has a wider bulbous end 132 which corresponds in shape to the back portion of the clamp, nearest the hub 116. A narrower end 134 of the flag piece 130 extends from the bulbous end 132 and corresponds to the shape of the distal arm 114 of the clamp housing 110. The narrower end 134 of the flag piece 130 may further include a projection portion 136 and a recessed portion 138. In one non-limiting embodiment as depicted in FIGS. 3 and 4, the projection portion 136 is located nearest to the opening 118 of the housing 110 and the recessed portion 138 is located in the interior of the clamp housing 110 between the projection portion 136 and the wider bulbous end 132. However, it is understood that the orientation of the projection portion 136 and recessed portion 138 may be reversed, such that the recessed portion 138 is positioned nearest to the opening 118.

The flag piece 130 may also include a notch 140 located near the opening 118 of the housing 110 that is configured to receive a lip 122 extending from the distal arm 114 of the housing 110. The connection between the notch 140 and lip 122 maintains the flag piece 130 within the housing 110 and resists any force applied to the edge 88, such as, if a child pushes against the wall.

The clamp 76, 78 further includes a locking piece 150 positioned adjacent to the proximal arm 112 of the housing 110. The locking piece 150 also includes a projection portion 152 and a recessed portion 154 oriented to oppose the projection portion 136 and recessed portion 138 of the flag piece 130. More specifically, in contrast to the configuration of the flag piece 130, the recessed portion 154 is located nearest to the opening 118 of the clamp housing 110 and the projection portion 152 is located within the clamp housing 110 across the interior cavity 120 from the recessed portion 138 of the flag piece 130. The locking piece 150 may further include a semicircular rib 156 extending from a proximal side 158 of the locking piece 150 and adapted to be retained within a corresponding notch 124 in the proximal arm 112 of the housing 110. The rib 156 and notch 124 effectively hold the locking piece 150 in place within the clamp housing 110 and resist force which acts to pull the edge 88 from the clamp 76.

When inserted within the clamp housing 110, the flag piece 130 and the locking piece 150 further define the shape of the interior channel 120, which extends from the clamp opening 110 to the bulbous end 132 of the flag piece 130. In one non-limiting embodiment, the interior channel 120 is curved or hook-shaped. Thus, the edge 88, maintained within the clamp 76, follows a curved or hook-shaped path through the channel 120. More specifically, the edge 88 is adapted to be retained within the interior channel 120, held in place by a frictional engagement between the edge 88, locking piece 150, and flag piece 130. The edge 88 exits the clamp 76 through the slit opening 118 extending longitudinally along the length of the upright post 56. The locking piece 150 and/or flag piece 130 may also include structure for biasing the edge 88 as it exits the clamp housing 110 at the housing opening 118, such as to direct the sheet in the direction of the respective enclosure wall. For example, as shown in FIGS. 3 and 4, the locking piece 150 may include a flange 160 located near the housing opening 118, for directing the curvature of the edge 88 as it exits the clamp housing 110. The end of the flag piece 130 may also include a similar curved end structure 142 for supporting the curvature of the fabric. By biasing the fabric in this way, a more aesthetically pleasing connection between the post 56 and enclosure 14 is created. Such a connection prevents the material of the enclosure 14 from bunching up, prevents unsightly twisting or folding, and which creates a flat and taut fabric wall for each side of the playpen or child enclosure apparatus, which inspires confidence in parents that the apparatus 10 is safe and secure.

With reference to FIGS. 1-4, the connection between the enclosure 14 and the post 56 is established according to the following steps. The flag piece 130 is connected to the edge 88 of the enclosure 14, as described above, with an adhesive or a mechanical connection such as stitching. The flag piece 130 and attached edge 88 are then inserted to the interior channel 120 clamp 76 through the housing opening 118. Once inserted within the clamp 76, the bulbous end 132 contacts the back portion of the housing 110 adjacent to the hub 116 and the narrower end 134 is positioned adjacent to the distal arm 114 of the housing 110. If present, the notch 140 is aligned with the lip 122 at the end of the distal arm 114 to securely maintain the flag piece 130 within the clamp housing 110. The edge 88 may be adjusted to ensure that there are no areas where the fabric is bunched up and that it exits the clamp with a taut, aesthetically pleasing appearance. The locking piece 150 is then inserted into the clamp housing 110 through an opening at the top end 68 of the post 56. The locking piece 150 slides in a downward direction through the clamp housing 110 to establish a frictional engagement with the edge 88 and flag piece 130. Thus, the pieces 130, 150 align such that the projection portion 152 of the locking piece 150 is positioned across the interior channel 120 from the recessed portion 138 of the flag piece 130 and the recessed portion 154 of the locking piece 150 across from the projection portion 136 of the flag piece 130. If present, the projecting rib 156 of the locking piece 150 is inserted within the corresponding notch 124 of the proximal arm 112. In this manner, the locking piece 150 exerts force against the edge 88, effectively maintaining the edge 88 within the locking piece 150 and ensuring that the walls of the child enclosure apparatus are taut.

Once the enclosure edges 88 are securely inserted into the clamps 76, the vertical corners 80, 82, 84, 86 are placed over the upright posts 56, 58, 60, 62 to cover the openings of the posts and to prevent the fabric edges from being removed from the posts. At this point, the coverings 92, 94, 96, 98 can be folded over the horizontal arms 22, 24, 26, 28, 30, 32, 34, 36 of the frame 12 to prevent the child from being injured by the joints between the arms 22, 24, 26, 28, 30, 32, 34, 36 and the stiffening members 46, 48, 50, 52. The user may also install lower corners 102, 104, 106, 108 to the bottom of the upright posts 56, 58, 60, 62, which function as feet for elevating the apparatus off the ground. At this point, the apparatus 10 is fully assembled and ready for use. In addition, an upper edge of the enclosure 14 may be connected to the upper arms 22, 24, 26, 28, 30, 32, 34, 36 of the frame 12 of the apparatus 10 in a manner similar to the manner in which the edges 88 are secured to the upright posts 56, 58, 60, 62.

While specific embodiments of the invented apparatus and method have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

The invention claimed is:

1. A play yard apparatus comprising:

a frame having a plurality of upright posts, the upright posts having a top, a bottom, and a clamp formed on at least one longitudinal side of the post, and a flexible enclosure having a plurality of edges inserted in the clamps, wherein the clamp comprises:

a housing having an opening for receiving at least one of the edges of the flexible enclosure and defining an interior channel within the housing, the housing comprising a proximal arm connected to the longitudinal side of the upright post and a distal arm;

a flag piece, which is positioned in the interior channel of the housing, connected to the edge of the enclosure; and a locking piece positioned across the interior channel from the flag piece, wherein a frictional engagement between the locking piece and the flag piece maintains the flag piece and the edge connected thereto in the interior channel, wherein an end of the distal arm located nearest the opening of the clamp includes an inward projecting lip adapted to be received within a recess of the flag piece for maintaining the flag piece within the clamp.

2. The apparatus of claim 1, wherein the opening of the housing is a longitudinal slit that extends along the clamp parallel to the longitudinal side of the upright post.

3. The apparatus of claim 1, wherein the housing has a u-shaped cross section.

4. The apparatus of claim 1, wherein the proximal arm of the housing includes a notch adapted to receive a corresponding rib of the locking piece to maintain the locking piece within the clamp.

5. The apparatus of claim 1, wherein the locking piece includes a projection portion and a recessed portion and wherein, when inserted in the interior channel of the clamp, the projection portion extends into the interior channel of the clamp farther than the recessed portion.

6. The apparatus of claim 5, wherein the flag piece includes a projection portion and a recessed portion that, when the flag piece and the locking piece are inserted in the interior channel, are positioned opposite from the projection and recessed portions of the locking piece thereby defining a curved path of the interior channel.

7. The apparatus of claim 1 further comprising upper corners covering the top of the posts for maintaining the edge of the flexible enclosure within the clamp.

8. The apparatus of claim 1, wherein the frame further comprises upper arm members connected between the tops of the upright posts.

9. The apparatus of claim 8, wherein the flexible enclosure includes coverings connected to the upper arm members of the frame.

10. The apparatus of claim 1, wherein the frame further comprises lower corners extending from the bottom of the posts for elevating the apparatus from a surface.

11. A play yard apparatus comprising:

a frame having a plurality of upright posts, the upright posts having a top, a bottom, and a clamp formed on at least one longitudinal side of the post, and a flexible enclosure having a plurality of edges inserted in the clamps, wherein the clamp comprises:

a housing having an opening for receiving at least one of the edges of the flexible enclosure and defining an interior channel within the housing, the housing comprising a proximal arm connected to the longitudinal side of the upright post and a distal arm;

a flag piece, which is positioned in the interior channel of the housing, connected to the edge of the enclosure; and a locking piece positioned across the interior channel from the flag piece, wherein a frictional engagement between the locking piece and the flag piece maintains the flag piece and the edge connected thereto in the interior channel, wherein the proximal arm of the housing includes a notch adapted to receive a corresponding rib of the locking piece to maintain the locking piece within the clamp.

12. The apparatus of claim 11, wherein the opening of the housing is a longitudinal slit that extends along the clamp parallel to the longitudinal side of the upright post.

13. The apparatus of claim 11, wherein the housing has a u-shaped cross section.

14. The apparatus of claim 11, wherein the locking piece includes a projection portion and a recessed portion and wherein, when inserted in the interior channel of the clamp, the projection portion extends into the interior channel of the clamp farther than the recessed portion.

15. The apparatus of claim 14, wherein the flag piece includes a projection portion and a recessed portion that, when the flag piece and the locking piece are inserted in the interior channel, are positioned opposite from the projection and recessed portions of the locking piece thereby defining a curved path of the interior channel.

16. The apparatus of claim 11, wherein an end of the distal arm located nearest the opening of the clamp includes an inward projecting lip adapted to be received within a recess of the flag piece for maintaining the flag piece within the clamp.

17. A play yard apparatus comprising:

a frame having a plurality of upright posts, the upright posts having a top, a bottom, and a clamp formed on at least one longitudinal side of the post, and a flexible enclosure having a plurality of edges inserted in the clamps, wherein the clamp comprises:

a housing having an opening for receiving at least one of the edges of the flexible enclosure and defining an interior channel within the housing;

a flag piece, which is positioned in the interior channel of the housing, connected to the edge of the enclosure; and a locking piece positioned across the interior channel from the flag piece, wherein a frictional engagement between the locking piece and the flag piece maintains the flag piece and the edge connected thereto in the interior channel, the locking piece comprising a projection portion and a recessed portion and wherein, when inserted in the interior channel of the clamp, the projection portion extends into the interior channel of the clamp farther than the recessed portion, wherein the flag piece includes a projection portion and a recessed portion that, when the flag piece and the locking piece are inserted in the interior channel, are positioned opposite from the projection and recessed portions of the locking piece.

18. The apparatus of claim 17, wherein the opening of the housing is a longitudinal slit that extends along the clamp parallel to the longitudinal side of the upright post.

19. The apparatus of claim 17, wherein the housing has a u-shaped cross section and comprises a proximal arm connected to the longitudinal side of the upright post and a distal arm.

20. The apparatus of claim 19, wherein the proximal arm of the housing includes a notch adapted to receive a corresponding rib of the locking piece to maintain the locking piece within the clamp.

* * * * *